US005130910A

United States Patent [19]

Engel

[11] Patent Number: 5,130,910

[45] Date of Patent: Jul. 14, 1992

[54] REFLECTIVE HOUSING FOR INCREASED LUMINANCE OF FLUORESCENT BULBS

[75] Inventor: H. Joseph Engel, Newport Beach, Calif.

[73] Assignee: Tek Tron Enterprises, Inc., Santa Ana, Calif.

[21] Appl. No.: 681,319

[22] Filed: Apr. 4, 1991

[51] Int. Cl.[5] ..... F21S 3/00

[52] U.S. Cl. ..... 362/217; 362/260

[58] Field of Search ..... 362/217, 260

[56] References Cited

U.S. PATENT DOCUMENTS

| | | |
|---|---|---|
| 167,187 | 8/1975 | Murch . |
| D. 194,405 | 1/1963 | Rodriguez et al. . |
| 1,189,231 | 7/1916 | Benjamin . |
| 1,225,032 | 5/1917 | Hotchkin . |
| 1,318,205 | 10/1919 | Helliwell . |
| 1,483,306 | 2/1924 | Julin et al. . |
| 1,651,431 | 11/1925 | Wood . |
| 1,847,482 | 7/1928 | Heymann . |
| 2,006,140 | 1/1933 | Honing . |
| 2,072,849 | 1/1935 | Dietrick . |
| 2,846,565 | 6/1956 | Binkley et al. . |
| 3,265,883 | 4/1964 | Tolbert . |
| 4,564,888 | 1/1986 | Lewin et al. . |
| 4,723,200 | 2/1988 | Troen . |
| 4,788,633 | 11/1988 | Zimmerman . |
| 4,947,297 | 8/1990 | Druffel et al. ..... 362/217 |

*Primary Examiner*—Carroll B. Dority

*Attorney, Agent, or Firm*—Knobbe, Martens, Olson & Bear

[57] ABSTRACT

A fluorescent light fixture assembly that provides unidirectional lighting having an intensity which is comparable to that provided by incandescent bulbs within parabolic reflective housings. The light fixture assembly comprises a fluorescent bulb, having an axis of extension, which is connected to an adaptor and a socket member. The fluorescent bulb is situated within a parabolic reflective housing having a longitudinal axis. The reflective housing is affixed to the adaptor so that the axis of extension of the fluorescent bulb is conspicuously angled with respect to the longitudinal axis of the reflective housing.

7 Claims, 3 Drawing Sheets

REFLECTIVE HOUSING FOR INCREASED LUMINANCE OF FLUORESCENT BULBS

FIELD OF THE INVENTION

The present invention relates to lighting fixtures, and, in particular, reflective housings for fluorescent light bulbs.

BACKGROUND OF THE INVENTION

Fluorescent light bulbs have become popular among consumers for a variety of reasons. For example, they are typically more energy efficient than conventional incandescent bulbs. In addition, fluorescent bulbs provide soft, even lighting in comparison to the bright "hot spots" exhibited in most incandescent bulbs. Thus, consumers often prefer fluorescent bulbs to incandescent bulbs in many lighting applications.

Although fluorescent bulbs offer several advantages over incandescent light bulbs, certain features of incandescent bulbs that are not typically found in fluorescent bulbs are considered desirable. In particular, incandescent light bulbs generally provide a roughly "point" source of light so that the light radiates in a substantially spherical pattern. It is well known that substantially all of the light which radiates from a point source can be focused in one direction by providing a parabolic reflective housing which surrounds the light source. This effect is commonly exhibited in flashlights and other unidirectional lighting devices. When the light source is positioned at the focal point of the parabola defined by the reflective housing, light radiating in any direction from the point source will be reflected in approximately the same direction as the rest of the light emanating from the source. Thus, incandescent bulbs that are properly positioned within parabolic reflective housings provide a means of producing strong (i.e., high intensity), unidirectional lighting.

In contrast, fluorescent bulbs typically emit light uniformly over the entire length of the bulb, rather than from a "point" filament, so that when a fluorescent tube is placed within a parabolic reflective housing, only light from a single spot (i.e., the spot which is situated at the focal point of the parabolic housing) will be reflected unidirectionally. For this reason, it is difficult to focus all of the useful light radiated from a fluorescent bulb in a desired direction. Thus, in applications where it is desired to provide strong, unidirectional lighting, it is often impractical to use a fluorescent bulb. Therefore, in spite of the advantages provided by fluorescent bulbs, consumers often use incandescent bulbs for applications where it is desired to provide strong, unidirectional lighting.

Thus, a need exists for a fluorescent bulb assembly that is capable of producing unidirectional lighting which has an intensity that is comparable to the intensity provided by incandescent light bulbs within parabolic reflective housings.

SUMMARY OF THE INVENTION

The present invention comprises a fluorescent bulb and reflective housing assembly which provides substantially unidirectional lighting having an intensity comparable to the intensity exhibited by incandescent bulbs within parabolic reflective housings. An elongated fluorescent bulb is surrounded by a reflecting housing having a longitudinal axis. The axis of extension of the fluorescent bulb is disposed at an angle with respect to the longitudinal axis of the reflective housing so that the focal point of the parabolic reflective housing is located approximately at the point of intersection between the two axes. The angle between the axis of extension of the fluorescent bulb, and the longitudinal axis of the reflective housing is advantageously within the range of 20° to 80°. This orientation of the fluorescent bulb within the reflective housing causes more of the light emitted from the bulb to be focused in a direction parallel to the longitudinal axis of the reflective housing.

DETAILED DESCRIPTION OF THE INVENTION

Figure 1:
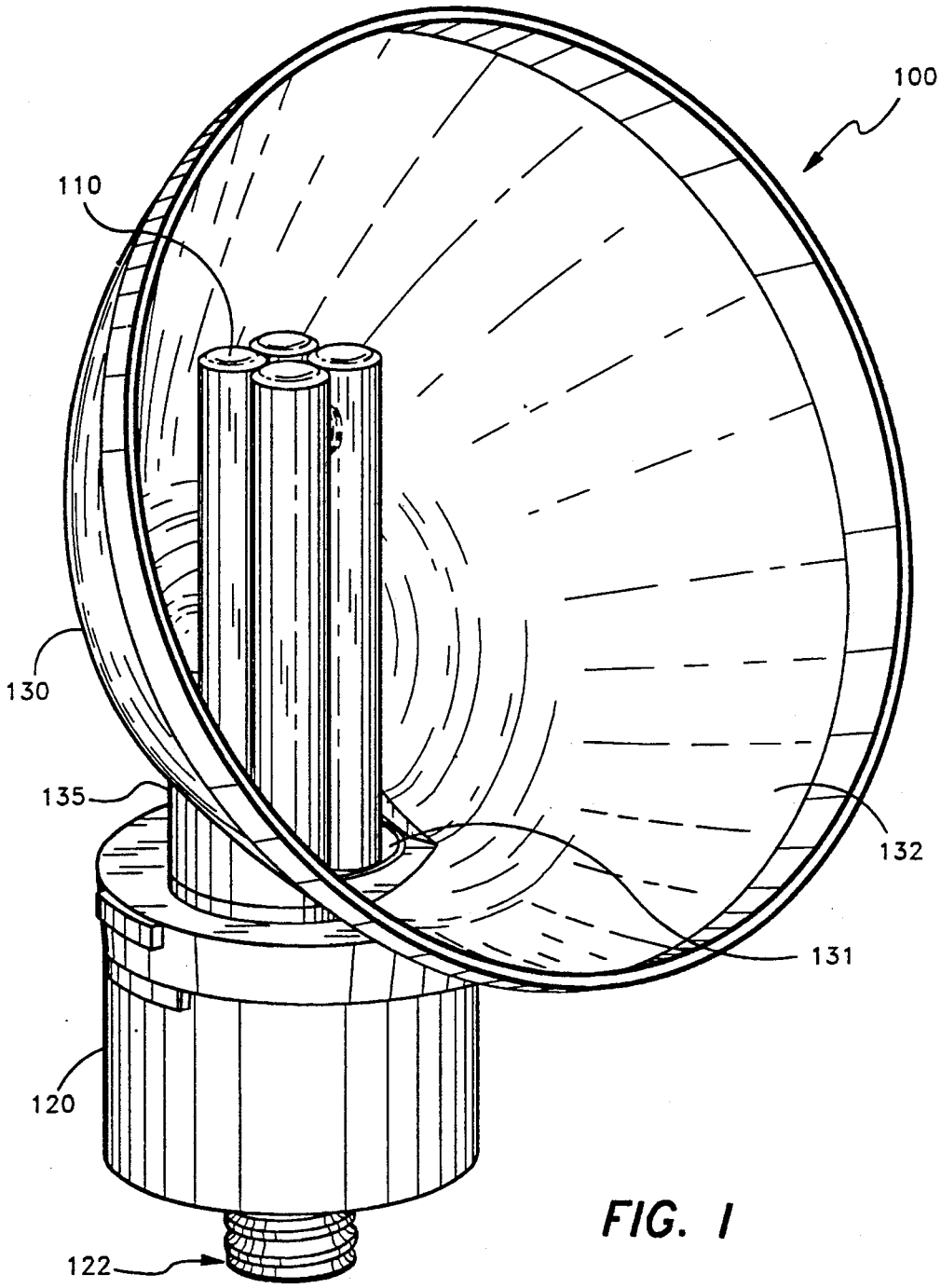
FIG. 1 is a perspective view of the fluorescent light fixture assembly incorporating the invention

Referring to FIG. 1, the fluorescent light fixture assembly 100 comprises a fluorescent light source or bulb 110, which is attached to a fluorescent bulb adaptor 120 having an Edison-type socket member 122 or an adapter for track lighting (not shown). The light fixture assembly 100 further comprises a concave parabolic housing 130 with a base or closed end **130*a* and an open mouth 130*b*. The housing is securely affixed to the adaptor 120 by way of a cylindrical neck 135 integrally formed with one side of the housing base 130*a*, extending about one third of the distance from the end of the base 130*a* to the mouth 130*b*. The housing 130 has an opening 131 at the end of the neck 135 so that the fluorescent bulb 110 protrudes therethrough when the housing 130 is affixed to the adaptor 120. With the arrangement shown, the base of the bulb 110 is in the opening 131**, with the bulb extending across the housing and the free end of the bulb being close to the reflector surface on the other side of the housing.

The housing 130 has a reflective parabolic inner surface 132, although the surface need not be strictly parabolic. In other embodiments, the housing may be semi-parabolic (i.e., parabolic along only a selected cross-section), or curved so that it is approximately parabolic. The housing is advantageously constructed of metal, durable plastic, or other suitable material which is sturdy and which may have a reflective coating applied to its inside surface.

In operation, the socket member 122 is inserted into a conventional light bulb socket (not shown). The socket supplies power to the adaptor 120 via the electrical connection made between the socket and the socket member 122. The adaptor 120 is advantageously constructed to convert the power supplied by the socket (e.g., 120 volts AC, @ 60 Hz) into power suitable to enable the fluorescent bulb 110. For example, the adaptor 120 may be a WESTERFIELD adaptor, model number ES 600 rated at 13 watts. Light emitted from the bulb 110 is reflected off of the reflective interior surface 132 so that the light is directed out through the open end of the housing 130. The bulb 110 illustrated is readily commercially available.

Figure 2:
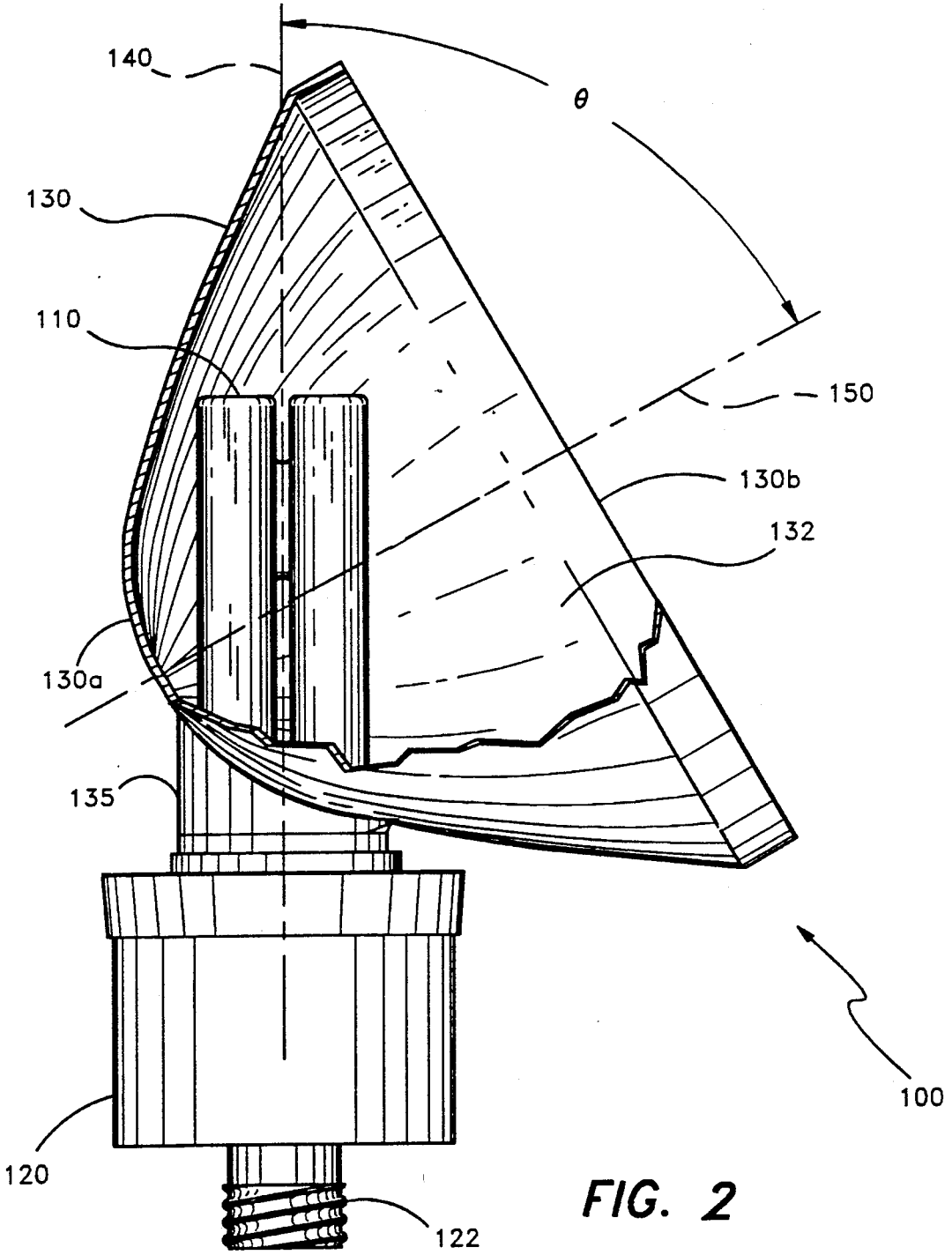
FIG. 2 is a cutaway side view of the fluorescent light fixture assembly which clearly illustrates the relative orientation between the fluorescent bulb and the reflective housing.

An axis of extension 140 of the light bulb 110, and a longitudinal axis 150 of the housing 130 are shown in FIG. 2. The axis of extension 140 of the light bulb 110 is disposed at an angle, $\theta$, with respect to the longitudinal axis 150 of the housing 130. In one embodiment, the angle $\theta$ measures approximately 60°, however, it will be understood that the assembly 100 may be constructed so that the angular relationship between the axis 140 and the axis 150 measures from about 20° to about 80°. With smaller or greater angles, the bulb becomes undesirably short, since its axis passes through the focal point of the reflective surface 132, and it is desirable that the axial enter of the bulb be close to the focal point.

As stated previously, substantially all of the light which radiates from a point source at the focal point of a parabolic reflector is reflected into unidirectional parallel rays. This is considered desirable, because all of the light emitted from the source can then be used to illuminate a desired region. Thus, substantially all of the light radiating from a point source at the focal point of a parabolic reflector is "useful" (i.e., is directed in parallel rays so that it illuminates a desired region).

In conventional devices, a fluorescent bulb is situated within a parabolic reflective housing so that the axis of extension of the fluorescent bulb is approximately collinear with the longitudinal axis of the housing. However, it has been found that the amount of "useful" light provided by such an arrangement is considerably less than that provided by incandescent bulbs.

The present invention increases the amount of "useful" light provided by the fluorescent bulb 110. Namely, it has been found that by orienting the fluorescent bulb 110 so that its axis 140 is appropriately angled with respect to the axis 150 of the housing 130, and so that the point of intersection of the axes 140, 150 is at the focal point of the parabolic reflective surface 132, more of the light radiated from the bulb 110 is provided as "useful" light when compared to conventional fluorescent bulb arrangements. That is, more of the light radiated from the bulb 110 is focused in a direction parallel to the longitudinal axis 150 of the reflective housing 130. Furthermore, it has been found that the intensity of the "useful" light provided by a light fixture assembly constructed in accordance with the present invention is comparable to that provided by incandescent bulbs situated within parabolic reflective housings. Thus, the present invention provides a fluorescent bulb assembly that is capable of producing unidirectional lighting which has an intensity that is comparable to the intensity provided by incandescent light bulbs within parabolic reflective housings.

Figure 3:
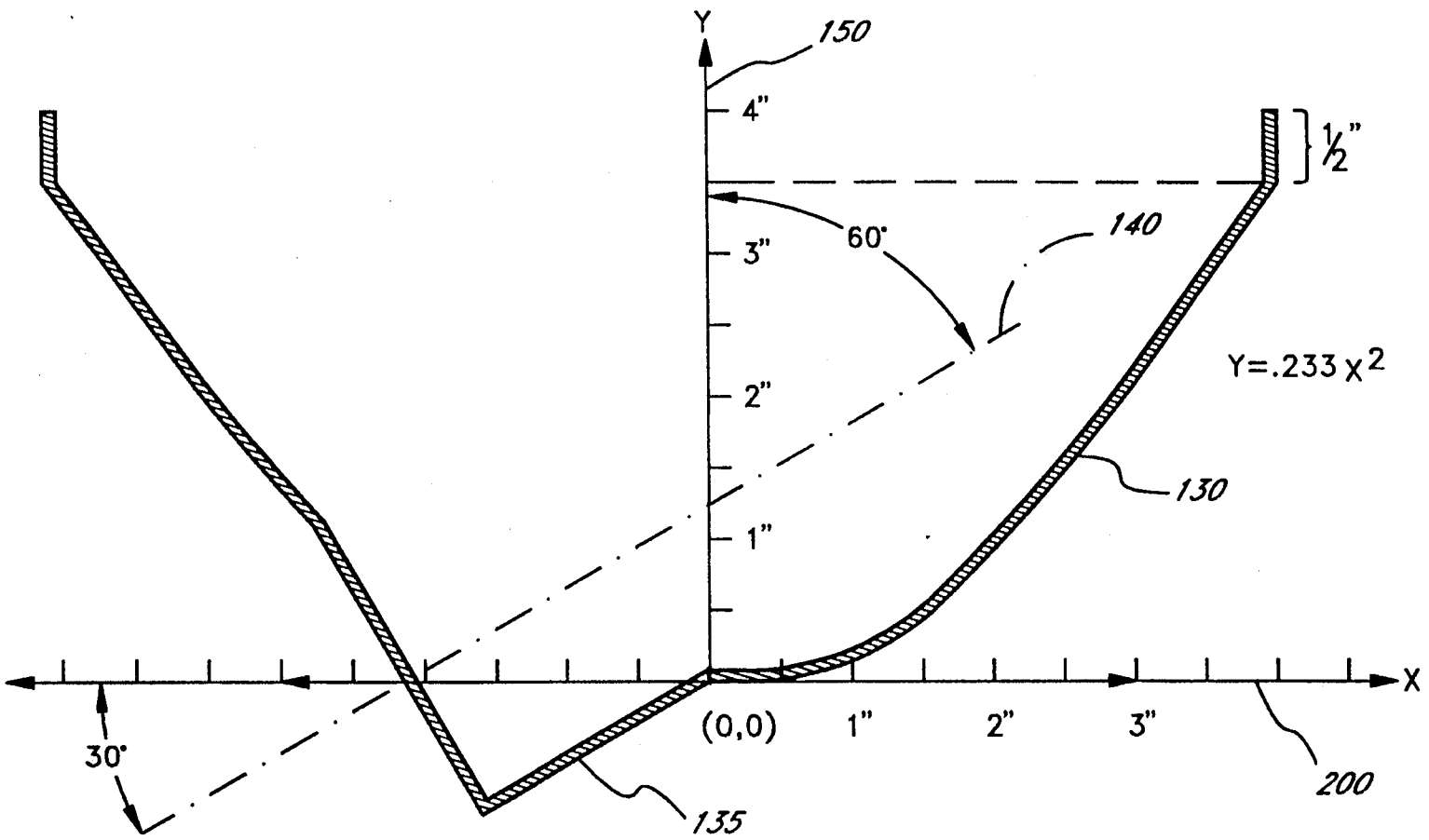
FIG. 3 is a cross-sectional view of the reflective housing superimposed onto a pair of coordinate axes to clearly illustrate the dimensions of the reflective housing.

Referring to FIG. 3, a cross section of the reflective housing 130 is superimposed onto X and Y coordinate axes such that the Y axis coincides with the longitudinal axis 150, of the housing. As shown, an X axis 200 is perpendicular to the Y axis (and thereby perpendicular to the longitudinal axis 150). The mathematical relationship between the X and Y coordinates of the points on the housing cross-section may be described as $Y=0.233X^2$, thus, the housing is parabolic in shape. For example, at $X=2''$, $Y=0.233(2^2)$, or $Y=0.932''$. In the embodiment shown, the mouth of the housing is 7.75" in diameter at its widest point, and is 4" from the base of the housing (i.e., at $X=0$, $Y=0$) to the uppermost portion of the housing. Note that the parabolic curvature of the housing extends from the base to approximately 3.5" above the base, at which point a half inch wide vertical lip is formed.

The neck 135 is integrally formed with the housing 130 at its base and is approximately 2" in diameter so that the fluorescent light bulb 110 may be inserted through the circular opening 131. The bulb 110 is inserted at an angle of approximately 60° with respect to the axis 150. The axis 140 of the bulb is shown for reference.

The focal point of the parabola described by the reflective housing 130 is located approximately at the intersection of the axis 140 and the axis 150. In the embodiment shown, this position corresponds to the coordinates (X=), Y=1.07"). The focal point of any parabola having a general equation $y=Kx^2$ may be found at the coordinates $[0,1/(4K)]$. Note that the focal point always lies on the axis of symmetry (i.e., the Y axis) of the parabola. A light fixture assembly constructed in accordance with these specifications will provide light comparable to that provided by an incandescent bulb situated within a parabolic reflective housing.

What is claimed is:

1. A light fixture assembly comprising:

a concave housing having a closed base extending outward to an open mouth, a reflective inner surface and a longitudinal axis extending from said base through the open mouth, said reflective inner surface having a focal point substantially along said longitudinal axis;

an elongated fluorescent bulb extending into said housing at one side of said base and extending across the interior of said housing with a free end of the bulb being close to said inner surface; and said housing and said bulb being oriented so that said longitudinal axis forms an angle between 20° and 80° with respect to a longitudinal axis of said bulb when said bulb is in its normal operating position, and said bulb axis approximately intersects said longitudinal axis approximately at said focal point.

2. The assembly of claim 1, wherein said housing is parabolic.

3. The assembly of claim 1, wherein said housing is semi-parabolic.

4. The assembly of claim 1, wherein said longitudinal axis is disposed at an angle of approximately 60° from said axis of extension.

5. A method of increasing the intensity of light emitted from a light fixture assembly comprising an elongated fluorescent bulb within a parabolic reflective housing, said bulb having an axis of extension and said housing having a focal point along a longitudinal axis, said method comprising the steps of:

inserting said bulb so that said axis of extension forms an angle between 20° and 80° with respect to said longitudinal axis in the normal operating position of the bulb; and orienting said housing so that said focal point of said housing coincides approximately with the point of intersection between said axis of extension and said longitudinal axis.

6. The assembly of claim 1, including a fluorescent bulb adaptor connected to the exterior of the housing at said one side of said base with one end of said bulb being connected to said adaptor adjacent said reflective inner surface.

7. The assembly of claim 6, including a neck formed integral with said housing, said neck being connected to said adaptor and surrounding a portion of said one end of said bulb.

* * * * *